US006745553B2

(12) United States Patent
Raasch

(10) Patent No.: US 6,745,553 B2
(45) Date of Patent: Jun. 8, 2004

(54) AIR-SPINNING ARRANGEMENT

(75) Inventor: Hans Raasch, Mönchengladbach (DE)

(73) Assignee: W. Schlafhorst AG & Company (DE)

( * ) Notice: Subject to any disclaimer, the term of this patent is extended or adjusted under 35 U.S.C. 154(b) by 58 days.

(21) Appl. No.: 10/246,985

(22) Filed: Sep. 19, 2002

(65) Prior Publication Data

US 2003/0056488 A1 Mar. 27, 2003

(30) Foreign Application Priority Data

Sep. 21, 2001 (DE) ..... 101 46 608

(51) Int. Cl.[7] ..... D01H 04/02; D01H 05/00
(52) U.S. Cl. ..... 57/400; 57/328
(58) Field of Search ..... 57/315, 328, 333, 57/350, 400, 403; 19/65 R, 98, 106 R, 246

(56) References Cited

U.S. PATENT DOCUMENTS

| | | | | |
|---|---|---|---|---|
| 5,187,930 A | | 2/1993 | Stahlecker | 57/400 |
| 5,768,878 A | | 6/1998 | Stahlecker | 57/401 |
| 5,890,356 A | | 4/1999 | Stahlecker | 57/401 |
| 6,058,693 A | | 5/2000 | Stahlecker et al. | 57/400 |
| 6,226,838 B1 | | 5/2001 | Raasch | 19/115 R |
| 6,308,507 B1 | * | 10/2001 | Dinkelmann | 57/75 |
| 2002/0100269 A1 | * | 8/2002 | Stahlecker | 57/403 |

FOREIGN PATENT DOCUMENTS

| | | |
|---|---|---|
| DE | 40 18 702 A1 | 1/1992 |
| DE | 196 01 038 A1 | 7/1997 |
| DE | 196 10 960 A1 | 9/1997 |
| DE | 196 13 192 A1 | 10/1997 |
| DE | 197 46 602 A1 | 4/1999 |
| DE | 197 48 615 A1 | 5/1999 |
| DE | 198 50 518 A1 | 5/2000 |
| JP | 3-152223 | 6/1991 |

OTHER PUBLICATIONS

German Search Report

* cited by examiner

*Primary Examiner*—John J. Calvert
*Assistant Examiner*—Shaun R Hurley
(74) *Attorney, Agent, or Firm*—Kennedy Covington Lobdell & Hickman, LLP

(57) ABSTRACT

An air-spinning arrangement has an opening device having a feed device and an opening roller for opening a sliver into individual fibers. A perforated removal roller receives the opened fibers from the opening roller in the circumferential direction. A conveyor belt conveys the fibers from the removal roller to a nip with a following air-spin nozzle for forming a yarn. The conveyor belt is arranged axially-parallel with the removal roller. A sufficiently close spacing of the conveyor belt from the removal roller is selected such that the fibers conveyed to the removal roller can be picked up by mechanical contact, and the conveyor belt is driven such that it deflects the fibers by approximately 90° and conveys them to the combing location. The air-spinning arrangement allows the formation of a fiber structure that is well suited to the air-spinning process.

7 Claims, 2 Drawing Sheets

AIR-SPINNING ARRANGEMENT

CROSS-REFERENCES TO RELATED APPLICATIONS

This application claims the benefit of German patent application 10146608.0, filed Sep. 21, 2001, herein incorporated by reference.

FIELD OF THE INVENTION

The present invention relates to an air-spinning arrangement having an opening device for opening a sliver.

BACKGROUND OF THE INVENTION

In connection with open-end spinning processes such as rotor spinning, a sliver is opened into individual fibers by means of an opening roller. For preventing fiber compressions in connection with air-spinning, or with open-end spinning methods, such as friction spinning, it is customarily desired that the fiber material can be continuously accelerated over the entire path from the feeding device of the opening roller to the yarn withdrawal device. In this way, the fibers remain stretched.

A spinning process is known from German Patent Publication DE 196 01 038 A1 in which several slivers are conducted to an opening roller. The opened fibers are removed from the opening roller by means of a perforated removal roller, to which suction is applied. The individual fibers are not to be slowed at the transfer points, but ideally are to be accelerated in order to prevent the compression of the fibers. The removal roller acts together with a friction roller. The fibers, while spinning, are withdrawn transversely in the conveying direction in the nip between the removal roller and the friction roller. A false twist is generated by the spin creation, which is turned out of the fiber structure downstream of the nip. In order that the fiber structure has stability, a pneumatic spin nozzle is arranged downstream of the nip. Fiber ends that have been released are to be wound around the fiber core in the spin nozzle. However, the release of fiber ends is made more difficult by the dissolving false twist. The yarn stability that can be achieved in this way is low.

German Patent Publication DE 196 10 960 A1 discloses a method for air-spinning, wherein slivers are also opened into individual fibers by an opening roller. Yarn formation occurs by means of a spinning device for twisting the yarn to be spun. A thin fiber fleece is to be formed from the opened individual fibers and the fibers of the thin fiber fleece are to be fed to a collecting surface extending transversely with respect to their direction of movement, from which they enter immediately thereafter into the spin device. In this case, the distance viewed over the working width, between the collecting surface and the previous fiber-conducting surface is not always constant. In connection with one embodiment, in which the collecting surface directly follows the opening roller, the fibers are hurled off the circulating combing elements and travel the distance to the collecting surface in an uncontrolled free flight. The fibers conveyed along with the combing elements can be located anywhere between the surface of the opening roller, or the base of a saw-toothed fitting, and the tip of the combing elements at a place that is mainly determined by accident. The release from the fittings of the opening roller takes place in free flight, wherein the distance traveled is a function of the initial position of the fibers in the fittings.

Free flight of the fibers to the collecting surface also takes place in the exemplary embodiment of German Patent Publication DE 196 10 960 A1, in which the collecting surface does not immediately follow the opening roller, but where the fibers are transferred from the opening roller to a removal roller, and are only fed to a collection surface from the removal roller. Viewed across the working width, the distance between the fiber-conducting surface of the removal roller and the following collecting surface is not constant. Thus, paths of different lengths for the fiber transfer result. The distance over which the fibers move in free flight can be relatively long. An uncontrolled free flight of the fibers holds the danger that a compression or random orientation of the fibers can result. This hampers the yarn formation, and lack of quality of the finished yarn occurs. The application of suction to the collecting surfaces leads to an additional use of air that, in spinning frames with a multitude of spinning stations, constitutes a considerable disadvantage.

German Patent Publication DE 197 46 602 A1, which defines the species, shows a spinning process in which slivers are opened by an opening roller, the individual fibers are taken over by a removal roller, and a thin fiber fleece is formed and combined on the removal roller. A slubbing-like fiber structure is intended to be created in the process, that is passed through a nip formed with the aid of the removal roller and fed to a pneumatically operating spinning nozzle. The combination of the thin fiber fleeces is achieved by means of an appropriate embodiment of the suction insert in the removal roller. The area of the removal roller to which suction is applied tapers in the conveying direction of the fibers. The combination of the thin fiber fleeces performed in this way only has a chance of success if a path of sufficient length is available for the combining. In order to obtain the required circumferential length, the combination of the thin fiber fleece has been parceled out to two successive suction rollers. Combining the thin fiber fleece in accordance with this process contains disadvantages since individual fibers can be sucked into the perforation of the removal roller and are not released at the edges of the area to which suction is applied as is required for functioning. They then remain attached to the removal roller in the form of so-called circulating fibers and often prevent other fibers from being released in the desired manner from the removal roller. Circulating fibers can result in yarn defects which are created in that the caught fiber is only released after several fibers have collected and adhere to it. The result is a slub in the yarn. Adhering fibers can also cause fiber windings on the removal roller and because of this can considerably interfere with the functioning of the spinning device, or can even stop it. A large consumption of suction air is created by the extensive areas to which suction is applied, in particular with two removal rollers to which suction is applied, which decisively interferes with the efficiency of the spinning process.

A friction spinning method is known from Japanese Publication JP (A) 3-15 2223, in which a belt is employed as the collecting surface. No speed conditions or distance settings are provided in this publication in connection with the working together of the individual elements. No air aspiration, wherein air is sucked off through the belt, can be seen, nor is it provided. Even though no additional extensive suction air consumption is created, the disclosed arrangement has disadvantages. The fiber structure formed from the collected fibers is given a twist by the friction belt, which goes counter to the use of the device in an air-spinning process, because the twisting interferes with air-spinning, and the yarn stability which can be achieved would be kept low. The friction belt clamps the fibers arriving at the collecting line, so that the withdrawal of the fiber structure, which is subjected to twisting, is made difficult.

SUMMARY OF THE INVENTION

It is accordingly an object of the present invention to improve the known arrangements for air-spinning.

According to the present invention, this object is addressed by an air-spinning arrangement comprising: an opening device having a feed device and an opening roller for opening a sliver into individual fibers; a perforated removal roller rotatable in a direction of revolution for receiving the opened fibers at a feeding zone adjacent the opening roller and transporting the opened fibers therefrom in the direction of revolution of the removal roller; a conveying device for transporting the fibers from the removal roller to a nip at a downstream located air-spin nozzle for forming a yarn, wherein the conveying device comprises a conveyor belt arranged downstream of the feeding zone and driven in axially parallel relation with the removal roller at a sufficiently close spacing to the removal roller for picking up the fibers from the removal roller by mechanical contact and deflecting the fibers by approximately 90° for delivery to the nip.

In accordance with the present invention, the conveyor belt surprisingly neither imparts a twist to the fiber structure formed in the nip and consisting of fibers taken over from the opening roller nor does the withdrawal of the fiber structure entail any difficulties. Following the deflection by 90°, the fibers lie stretched and parallel in the strand-like fiber structure. This position of the fibers is maintained during their conveyance through the following nip to the air-spin nozzle, and makes possible very good spinning of the fiber structure by means of an air-spinning process.

No additional application of suction is required for the functioning of the conveyor belt as the collecting surface for the fibers. Therefore, corresponding additional suction air consumption is avoided, and the efficiency when using the air-spinning arrangement in accordance with the present invention is not hampered.

In connection with a conveyor belt that is arranged tangentially in relation to the removal roller, the transfer of the fibers from the removal roller to the conveyor belt is aided. An air flow coming from below is generated in the lower nip between the removal roller and the conveyor belt by means of applying suction to the perforated removal roller that aids in the release of the fibers from the removal roller.

If, as in one embodiment of the present invention, a sufficiently close spacing of 0.2 mm to 0.7 mm is selected as the smallest distance, on the one hand the surface of the conveyor belt is positioned close enough to the removal roller for picking up the fibers conveyed on the removal roller by means of a mechanical contact and to prevent the free uncontrolled flight of the fibers, on the other hand is the surface of the conveyor belt sufficiently far removed from the removal roller to prevent the application of a spin generated by friction to the fiber structure, or to make the fiber removal from the nip more difficult.

In another embodiment of the present invention, a conveyor belt with a microscopically roughened surface, or made of a material with a high coefficient of friction improves the pickup and conveyance of the fibers by the conveyor belt without interfering with the release from the conveyor belt.

In yet another embodiment of the present invention, a conveyor belt that is impermeable to air prevents undesired interference with the air flow directed to the nip from below and increases the dependability of the release process of the fibers from the removal roller.

In still yet another embodiment of the present invention, a layout of the conveyor belt drive mechanism wherein the speed of the conveyor belt is slightly greater than or equal to the circumferential speed of the removal roller aids in the prevention of compression of the fibers.

The air-spinning arrangement in accordance with the present invention permits the efficient and unhampered production of a yarn in accordance with the air-spinning process and overcomes disadvantages of known arrangements.

Further details of the present invention can be gathered from a non-limiting exemplary embodiment presented in the following description with reference made to the drawings.

DESCRIPTION OF THE PREFERRED EMBODIMENT

Figure 1:
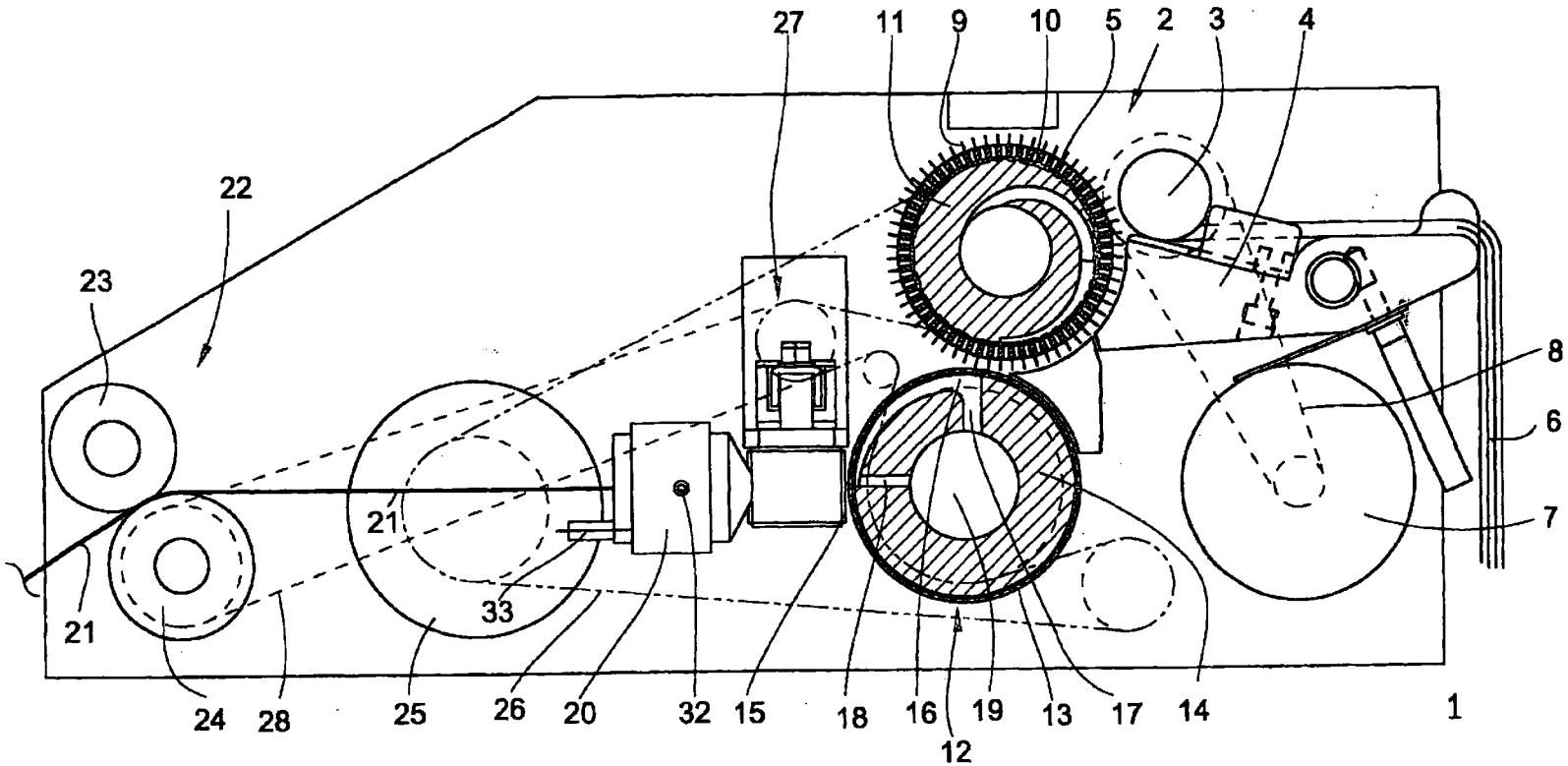
FIG. 1 is a lateral view of an air-spinning arrangement having a conveyor belt running along the removal roller.

The air-spinning arrangement 1 represented in FIG. 1 has a fiber opening device 2 with a draw-in roller 3, feeding trough 4 and opening roller 5. A material feed consisting of several slivers 6 passes through a nip formed by the draw-in roller 3 and the feeding trough 4 and is conveyed to the opening roller 5. Three slivers are fed in next to each other in the represented exemplary embodiment, seen in FIG. 2. The draw-in roller 3 is driven in the customary way by a motor 7 via a toothed belt 8, wherein the number of revolutions can be set in an infinitely variable manner. On its circumference, the opening roller 5 is equipped with combing elements in the form of needles 9. In an alternative embodiment (not shown), the opening roller is constituted by a saw-toothed wire fitting. After passing through the nip, the fed-in fiber material is grasped by the needles 9 of the rotating opening roller 5 and is taken along. The surface of the opening roller 5 has a multitude of bores 10, each arranged between two needles 9. A stationary, unmoving suction insert 11 is arranged in the opening roller 5, which is connected to a vacuum source (not shown). A vacuum is applied by means of the suction insert 11 over an area that includes approximately a quarter of the circumference of the opening roller 5 and extends from the combing location as far as the transfer location, or the feeding zone of the fibers, to the removal roller 12. The fibers grasped by the needles 9 and released out of the fiber structure of the material feed are aspirated by the vacuum existing at the bores 10. The combing of the fibers out of the fiber structure of the material feed is intensified because of this and the take-along of the fibers by means of friction, even at slow combing speeds, is improved. The immediate take-along of the combed-out fibers is intended to prevent that the fibers lose their stretched position, or are compressed by the needles 9. For improving the opening of the slivers, it is, for example, alternatively possible to equip the fiber opening device 2 with a support roller that meshes with the opening roller 5, or with other means, such as known from German Patent Publication DE 198 50 518 A1, for example.

The surface 13 of the removal roller 12 that rotates in a counterclockwise direction in the representation in FIG. 1 is perforated. The suction insert 14 that is fixedly arranged inside the removal roller 12 is also connected to the previously mentioned vacuum source. A vacuum is applied to the surface 13 of the removal roller 12 with the aid of the suction insert 14 in the area between the spot in which the fibers are transferred from the opening roller 5 to the removal roller 12, and the spot where the fibers are removed from the removal roller 12 to the conveyor belt 15. The cutout 16 in the suction insert 14 is connected via the air conduits 17 and 18 and via the vacuum chamber 19 with the vacuum source. The air flowing to the air conduit 17 aids the transfer of the fibers from the opening roller 5 to the removal roller 12, and the air flowing to the air conduit 18 aids the release of the fibers from the removal roller 12. The conveyor belt 15 extends in an axially-parallel manner and tangentially in relation to the removal roller 12 at a distance of 0.4 mm.

A portion of the air aspirated by the air conduit 18 flows from below into the nip between the surface 13 and the conveyor belt 15. Here, this airflow aids the release of the fibers from the removal roller 12. The fibers are caught by the conveyor belt 15, are deflected by 90° into the conveyance direction of the conveyor belt 15 and taken along by it. The conveyor belt 15 has a slightly higher speed than the circumferential speed of the surface of the removal roller 12. To increase the dependability of the transfer process, the conveyor belt 15 has a microscopically roughened surface and is made of soft caoutchouc. The fibers that are taken along form a strand-like fiber structure of parallel arranged fibers on the conveyor belt 15. After the deflection by 90°, the fiber structure passes through a nip and thereafter passes through the air-spin nozzle 20.

It is achieved by means of the air-spin nozzle 20 that the fiber structure is charged with an air flow which rotates around the passing fiber strand. In the process, the fiber ends are spread away from the fiber structure and are wound around the so-called core fiber. The principle of such air-spinning processes is known from German Patent Publication DE 197 46 602 A1, for example.

After the air-spin nozzle 20, the yarn 21 passes through a withdrawal device 22, wherein the withdrawal rollers 23 and 24 form a nip point. The yarn 21 spun in this manner is wound on a cheese (not shown). The driving of the opening roller 5 and the removal roller 12 is provided by the motor 25 and via the belt 26. The belt 26 drives the conveyor belt 15 via the gear arrangement 27, and by means of the belt 28 the withdrawal rollers 23 and 24. From the opening roller 5 to the withdrawal device 22 the opening roller 5, the removal roller 12, the conveyor belt 15 and the withdrawal rollers 23 and 24 each have a slightly rising circumferential speed. The gear ratios remain the same for each spinning speed.

Figure 2:
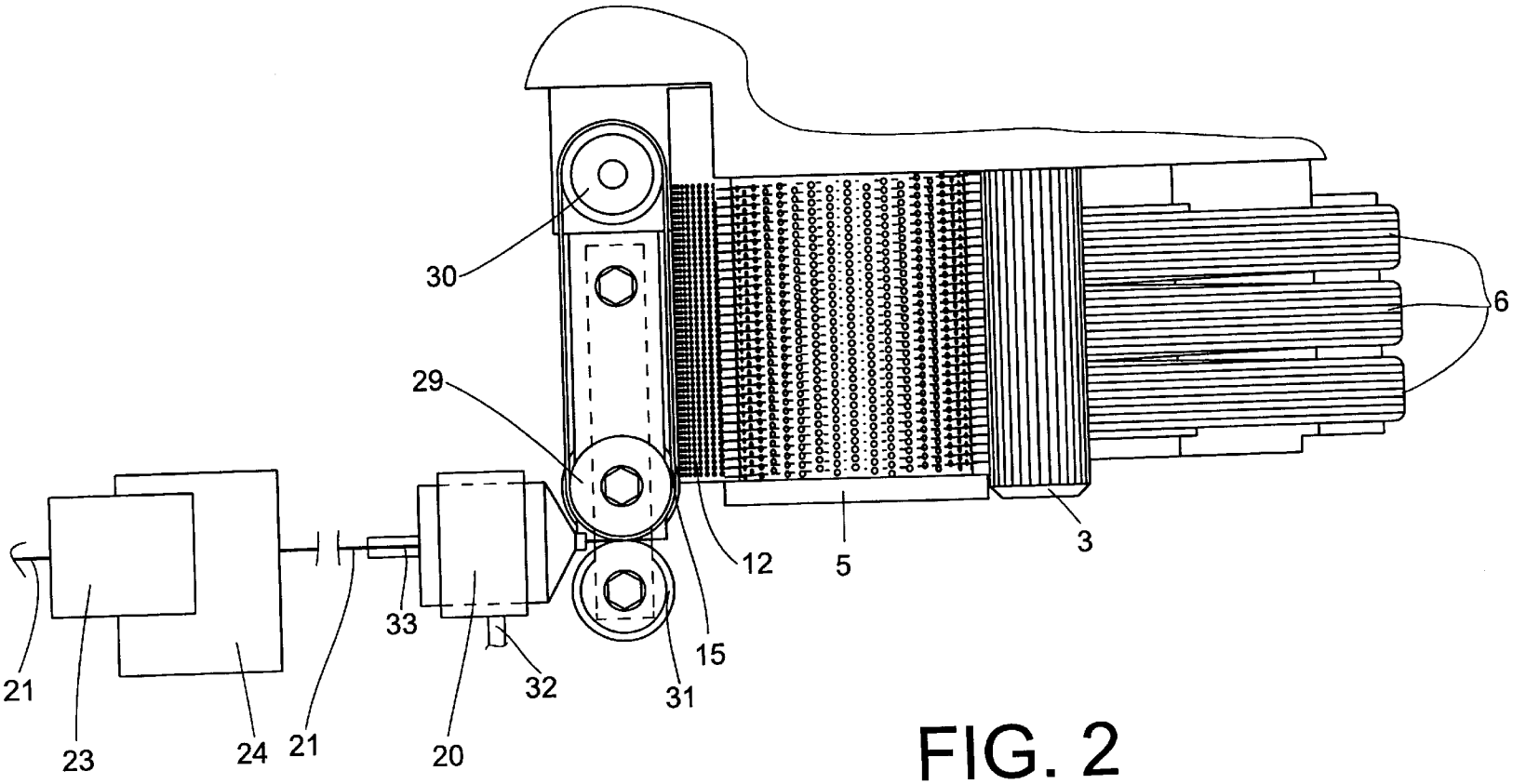
FIG. 2 is an overhead view of a simplified version of the air-spinning arrangement of FIG. 1.

It can be seen in the simplified view from above on the air-spinning arrangement 1 in FIG. 2 that the toothed opening roller 5 is relatively wide in comparison with opening rollers, such as are used with rotor spinning. Matched to this width, three slivers 6 placed next to each other are simultaneously fed to the draw-in roller 3.

The conveyor belt 15 runs over deflection rollers 29 and 30 and is arranged in such a way that it extends along the entire perforated working width of the removal rollers 12. The resiliently seated gripping roller 31 presses against the deflection roller 29, or the conveyor belt 15. The fibers are released from the removal roller 12, are deflected in their movement direction by 90° by the conveyor belt 15 and are collected into a strand-like fiber structure. The fiber structure follows the deflection of the conveyor belt 15 at the deflection roller 29 as far as to the nip line between the deflection roller 29 and the gripping roller 31. The air-spin nozzle 20 projects into the nip formed by the deflection roller 29 and the gripping roller 31. The air-spin nozzle 20 is connected via the connector 32 with a compressed air source (not shown). The compressed air is used for generating the rotating air flow with which the fiber structure is charged in the air-spin nozzle 20. During the spinning operation the air pressure is 5 to 9 bar. The connector 33 is connected with a vacuum source. Fibers that are released during piecing or spinning are aspirated by means of the connector 33. The vacuum for aspirating the fibers that are individually released from the fiber structure is approximately 20 mbar. A higher vacuum of approximately 100 mbar is applied during piecing, by means of which the fibers are aspirated off the conveyor belt 15 when the compressed air supply to the air-spin nozzle 20 is interrupted. In the course of this, the gripping roller 31 is lifted off the conveyor belt 15. The suction flow causes the fibers to initially follow the deflection of the conveyor belt 15 around the deflection roller 29, after which they are aspirated by the air-spin nozzle 20. At the start of piecing, a piecing yarn, which is first guided around the lifted gripping roller 31, is drawn into the air-spin nozzle 20, which was drawn out of the nip. When the fiber structure aspirated off the conveyor belt 15 passes through the air-spin nozzle 20 together with the piecing yarn, the gripping roller 31 is placed against the conveyor belt 15, the compressed air supply for charging the fiber structure with a rotating air flow is turned on, and the vacuum from the vacuum source is set to approximately 20 mbar instead of 100 mbar.

The fibers are combined with the piecing yarn. Feeding of the piecing yarn is stopped after the spinning process has been started. The narrow sliver is still further drawn into the air-spin nozzle 20 after the gripping roller 31 has again been placed against the conveyor belt 15. The fibers follow the deflection of the conveyor belt 15 even without suction air, because the deflection track is considerably shorter than the staple length of the fibers. Therefore, shortened fibers contained in the fiber structure also follow the deflection, because they are guided, or supported, by the longer fibers. The withdrawal device 22 is activated synchronously with the application of the gripping roller 31 to the conveyor belt 15 in that the withdrawal roller 23 is placed against the driven withdrawal roller 24.

After passing through the withdrawal device 22, the yarn 21 is conducted to a winding arrangement (not shown) for producing a cheese.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. An air-spinning arrangement comprising:

an opening device having a feed device and an opening roller for opening a sliver into individual fibers, a perforated removal roller rotatable in a direction of revolution for receiving the opened fibers at a feeding zone adjacent the opening roller, the opened fibers remaining directed in the direction of revolution of the removal roller and transporting the opened fibers therefrom, a conveying device for transporting the fibers from the removal roller to a nip at a downstream located air-spin nozzle for forming a yarn, wherein the conveying device comprises a conveyor belt arranged downstream of the feeding zone and driven in axially parallel relation with the removal roller at a sufficiently close spacing to the removal roller for picking up the fibers from the removal roller by mechanical contact and deflecting the fibers by approximately 90° for delivery to the nip.

2. The air-spinning arrangement in accordance with claim 1, wherein the conveyor belt is arranged tangentially with respect to the removal roller.

3. The air-spinning arrangement in accordance with claim 1, wherein the sufficiently close spacing is 0.2 mm to 0.7 mm.

4. The air-spinning arrangement in accordance with claim 1, wherein the conveyor belt has a miscroscopically roughened surface at least on a side facing the fibers.

5. The air-spinning arrangement in accordance with claim 1, wherein the conveyor belt is of a material with a high coefficient of friction.

6. The air-spinning arrangement in accordance with claim 1, wherein the conveyor belt is impermeable to air.

7. The air-spinning arrangement in accordance with claim 1, wherein the conveyor belt comprises a drive mechanism laid out in such a way that the conveyor belt has a speed slightly greater than or equal to a circumferential speed of the removal roller.

* * * * *